US008109603B2

(12) United States Patent
Kinoshita

(10) Patent No.: US 8,109,603 B2
(45) Date of Patent: Feb. 7, 2012

(54) RECORDING APPARATUS

(75) Inventor: Hiroyuki Kinoshita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/467,676

(22) Filed: May 18, 2009

(65) Prior Publication Data

US 2009/0295850 A1 Dec. 3, 2009

(30) Foreign Application Priority Data

May 28, 2008 (JP) ..... 2008-139500

(51) Int. Cl.
*B41J 23/00* (2006.01)
*B41J 25/308* (2006.01)

(52) U.S. Cl. ..... 347/37; 347/8

(58) Field of Classification Search ..... 347/8, 37
See application file for complete search history.

(56) References Cited

U.S. PATENT DOCUMENTS 5,917,518 A * 6/1999 Ohashi et al. ..... 347/37
6,899,474 B2 5/2005 Uchida et al.
7,585,123 B2 * 9/2009 Ueda et al. ..... 347/8
2006/0132535 A1 * 6/2006 Kumagai et al. ..... 347/37

FOREIGN PATENT DOCUMENTS

JP 7-276736 10/1995
JP 2000-198244 7/2000
JP 2004-42346 2/2004

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

Durability of a recording apparatus is enhanced. The recording apparatus includes: a carriage that carries a recording head which discharges a liquid onto a recording medium; and a guide unit that supports the carriage so as to be freely movable. The carriage has a first sliding surface and a second sliding surface. The first sliding surface is slidable on the guide unit, and the second sliding surface is displaceable with respect to the carriage and slidable on the guide unit. The recording apparatus is switchable between a first condition in which the guide unit and the first sliding surface are in contact with each other, and a second condition in which the guide unit and the second sliding surface are in contact with each other.

12 Claims, 14 Drawing Sheets

RECORDING APPARATUS

BACKGROUND OF THE INVENTION

1. Field of the Invention

The present invention relates to a recording apparatus that discharges a liquid from a recording head to record an image onto a recording medium.

2. Description of the Related Art

A recording apparatus such as a printer, a copier, or a facsimile machine includes a recording head and a conveying unit. The recording head discharges ink, which is a liquid, onto a flat recording medium such as paper or a plastic sheet. The conveying unit conveys the recording medium to a position facing the recording head.

The recording head is carried by a carriage that can reciprocate in a direction (hereafter referred to as a main scanning direction) orthogonal to a recording medium conveyance direction. The recording apparatus discharges ink onto the recording medium with the reciprocating movement of the carriage. This allows a recorded image to be formed on the recording medium.

To obtain a recorded image of favorable image quality, it is necessary to accurately reciprocate the carriage in a state where a gap (hereafter referred to as a paper gap) between the recording head and the recording medium is maintained within an appropriate range. Accordingly, the carriage is supported slidably on a guide shaft extending along the main scanning direction (for example, see Japanese Patent Application Laid-Open No. 2000-198244, Japanese Patent Application Laid-Open No. H07-276736, and Japanese Patent Application Laid-Open No. 2004-042346).

Furthermore, a recording apparatus having a function of adjusting the paper gap is disclosed in Japanese Patent Application Laid-Open No. H07-276736 and Japanese Patent Application Laid-Open No. 2004-042346.

However, the recording apparatus disclosed in the above-mentioned patent documents has the following problem. A surface (hereafter referred to as a contact surface) of the carriage in contact with a guide unit slides during a recording operation of the recording apparatus. This causes the contact surface to gradually abrade each time the recording apparatus is used. The abrasion of the contact surface changes the paper gap, as a result of which the image quality of the recorded image decreases.

Though the recording apparatus disclosed in Japanese Patent Application Laid-Open No. H07-276736 and Japanese Patent Application Laid-Open No. 2004-042346 includes the function of adjusting the paper gap, this function does not cope with the change of the paper gap caused by the abrasion of the contact surface.

Therefore, in the case of continuing to use the recording apparatus, the change of the paper gap caused by the abrasion resulting from the reciprocating movement of the carriage becomes not negligible. This leads to a decrease in durability of the recording apparatus.

SUMMARY OF THE INVENTION

In view of the above-mentioned problems of the related art, an object of the present invention is to provide a recording apparatus of high durability.

To achieve the stated object, the present invention is a recording apparatus including: a carriage that carries a recording head which discharges a liquid onto a recording medium; and a guide unit that supports the carriage so as to be freely movable, wherein the carriage has a first sliding surface and a second sliding surface, the first sliding surface being slidable on the guide unit, the second sliding surface being displaceable with respect to the carriage and being slidable on the guide unit, and wherein the recording apparatus is switchable between a first condition in which the guide unit and the first sliding surface are in contact with each other, and a second condition in which the guide unit and the second sliding surface are in contact with each other.

According to the present invention, the durability of the recording apparatus can be enhanced.

Further features of the present invention will become apparent from the following description of exemplary embodiments with reference to the attached drawings.

DESCRIPTION OF THE EMBODIMENTS

The following describes embodiments of the present invention, with reference to drawings. Though an ink jet recording apparatus which uses recording paper as a recording medium is described below as an example, the present invention is not limited to recording paper, and is also applicable to all kinds of apparatuses that record onto flat recording media such as a plastic sheet and a recording disc.

First Embodiment

Figure 1:
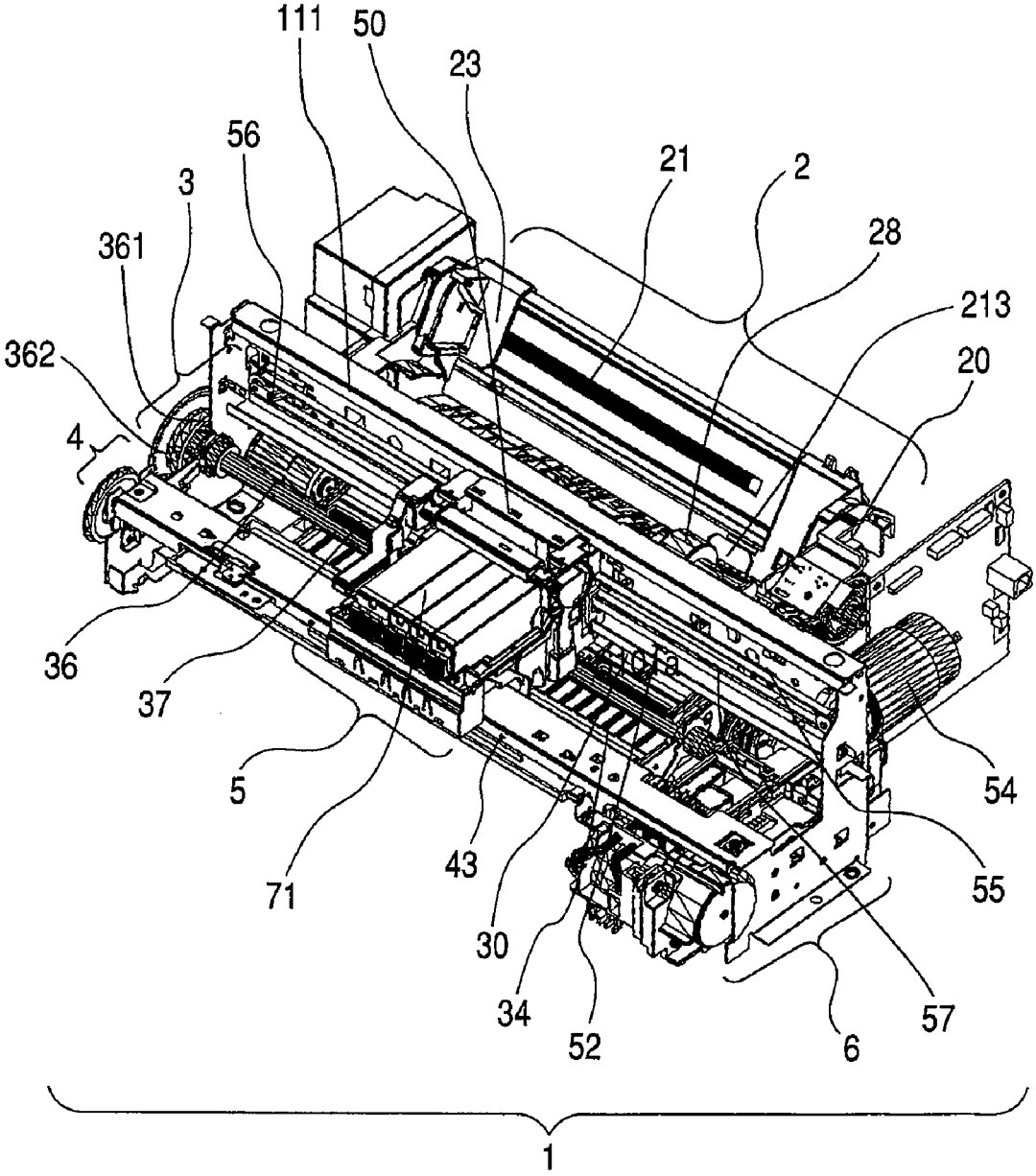
FIG. 1 is a schematic perspective view of a recording apparatus in a first embodiment of the present invention.
Figure 2:
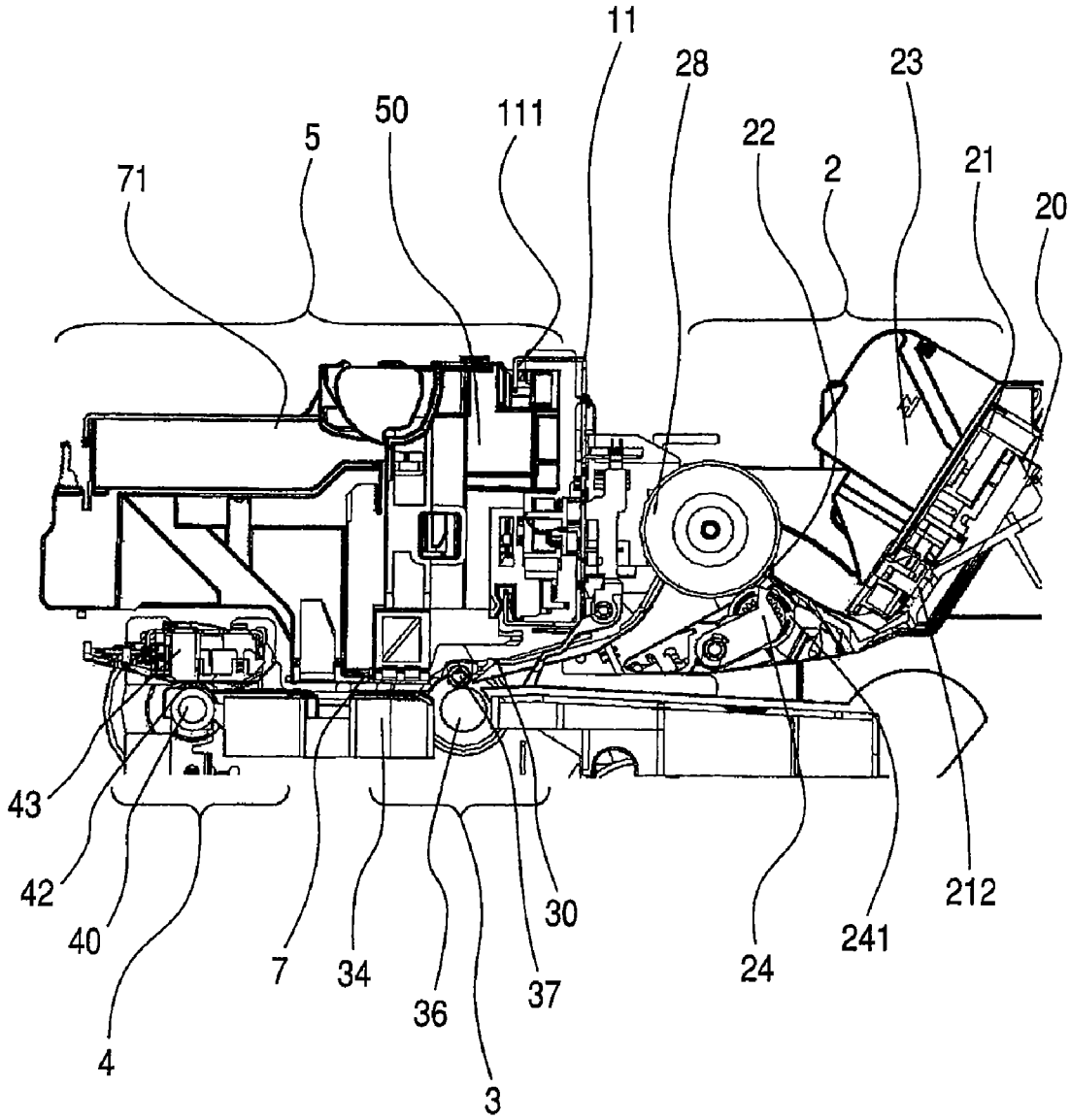
FIG. 2 is a schematic side view of the recording apparatus in the first embodiment of the present invention.

FIG. 1 is a schematic perspective view of a recording apparatus in an embodiment of the present invention, and FIG. 2 is a schematic side view of the recording apparatus in FIG. 1. A recording apparatus 1 includes a feeding unit 2, a conveying unit 3, an ejection unit 4, a carriage unit 5, and a cleaning unit 6.

The carriage unit 5 includes a recording head 7 that discharges ink which is a liquid, and a carriage 50 that carries the recording head 7. The recording head 7 discharges a liquid (such as ink) to record onto a recording medium.

The recording medium is loaded in the feeding unit 2, and conveyed to a position facing the recording head 7 through the conveying unit 3. The recording medium on which recording is performed is ejected outside the recording apparatus 1 through the ejection unit 4. The cleaning unit 6 is provided to perform a recovery process of the recording head 7.

The following provides an overview of main components of the recording apparatus 1.

(A) Carriage Unit

Figure 3:
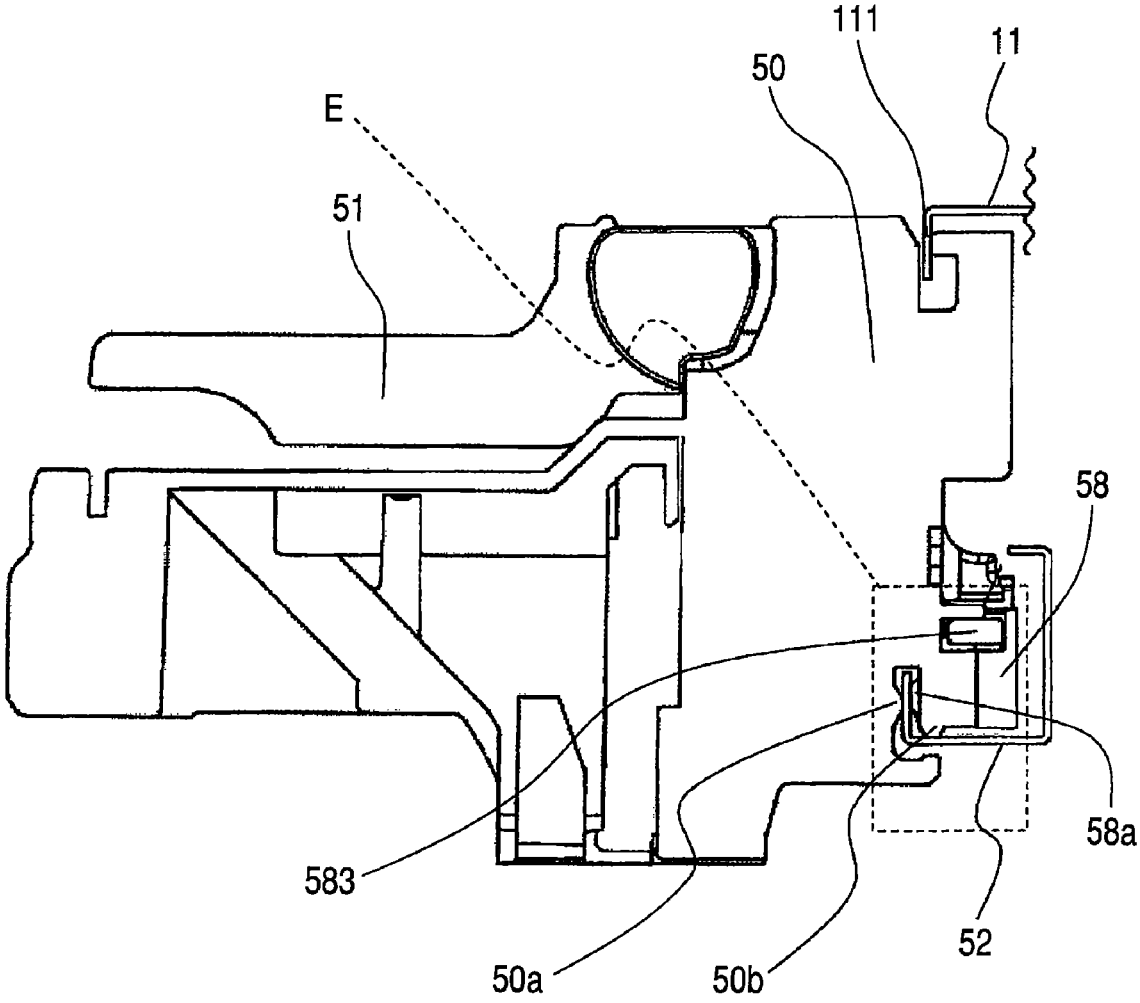
FIG. 3 is a schematic side view of a carriage unit in the first embodiment.
Figure 4:
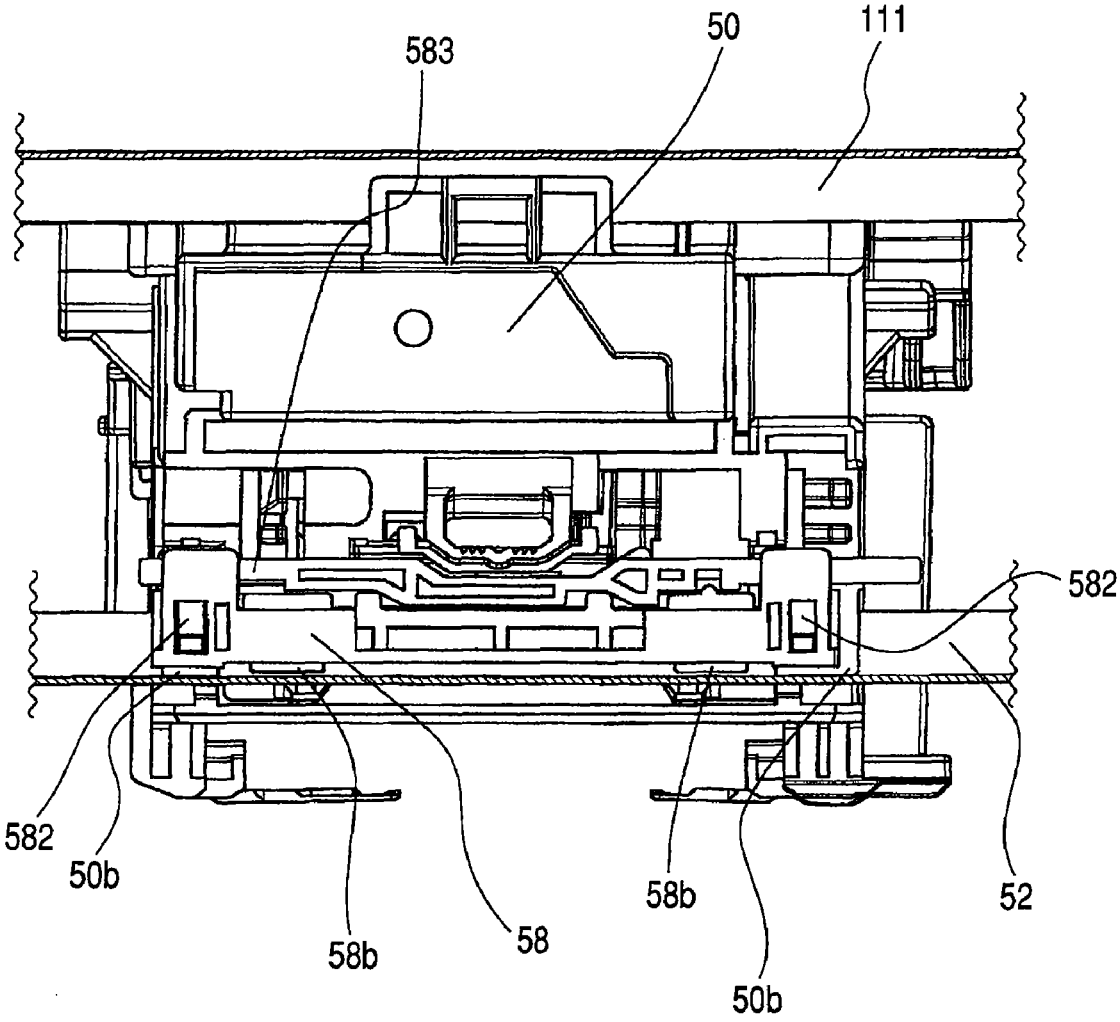
FIG. 4 is a schematic back view of the carriage unit in the first embodiment.

FIG. 3 is a schematic side view of the carriage unit in this embodiment, and FIG. 4 is a schematic back view of the carriage unit in this embodiment. FIG. 3 illustrates the carriage unit 5 in a state of not carrying a liquid accumulating portion.

The carriage unit 5 includes the carriage 50 that carries the recording head 7. The recording head 7 is fixed to the carriage 50 by a head set lever 51 provided in the carriage 50.

In the recording apparatus 1, a platen 34 is disposed so as to face a surface (hereafter also referred to as a discharge surface) of the recording head 7 from which the liquid is discharged (see FIG. 2). The platen 34 is provided to support the recording medium conveyed from the feeding unit 2.

The discharge surface of the recording head 7 faces the recording medium supported by the platen 34, in a state of maintaining an appropriate gap. Hereafter, the gap between the discharge surface of the recording head 7 and the recording medium is referred to as a paper gap.

The carriage 50 is supported by a guide unit 52 and a support unit 111 extending along the main scanning direction, and is freely movable in the main scanning direction.

The support unit 111 is in a state of being sandwiched by the carriage 50 in a recording medium conveyance direction. The support unit 111 is integrally molded with a chassis 11 of the recording apparatus 1, and supports an upper end of the carriage 50. The carriage 50 is supported slidably in the main scanning direction.

The posture of the carriage 50 is maintained by pressing the upper end of the carriage 50 against the support unit 111 under its own weight.

The guide unit 52 is attached to the chassis 11. The guide unit 52 fixes the carriage 50 in position in a direction (hereafter referred to as a height direction) orthogonal to a main surface of the platen 34 or the recording medium supported by the platen 34.

A first sliding surface 50*b* and a third sliding surface 50*a* are formed at a lower end of the carriage 50 in the height direction. The first sliding surface 50*b* is perpendicular to the height direction, and the third sliding surface 50*a* is perpendicular to the recording medium conveyance direction.

Figure 5:
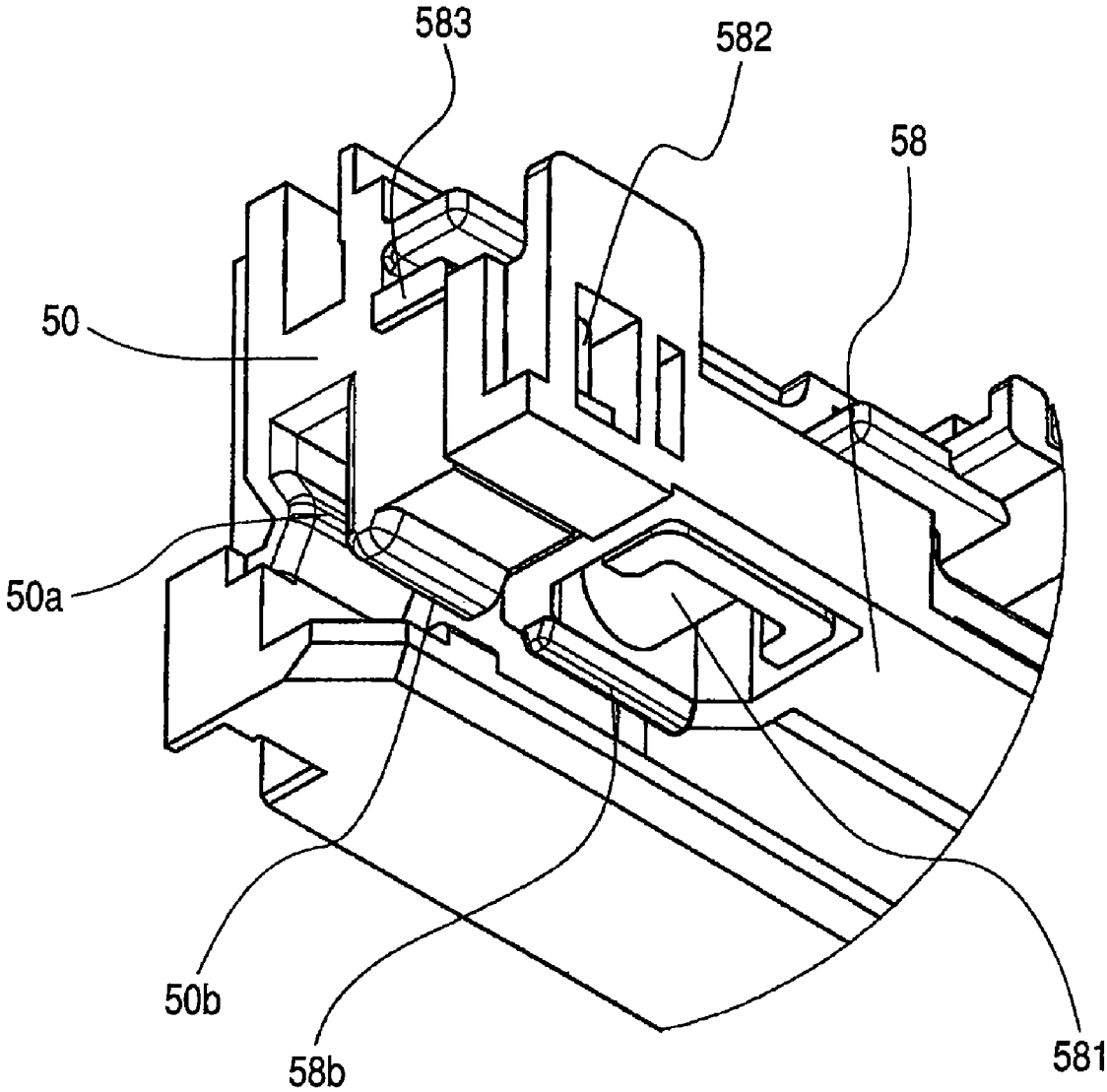
FIG. 5 is an enlarged perspective view of a movable unit and a slide unit of the carriage and their vicinities.
Figure 6:
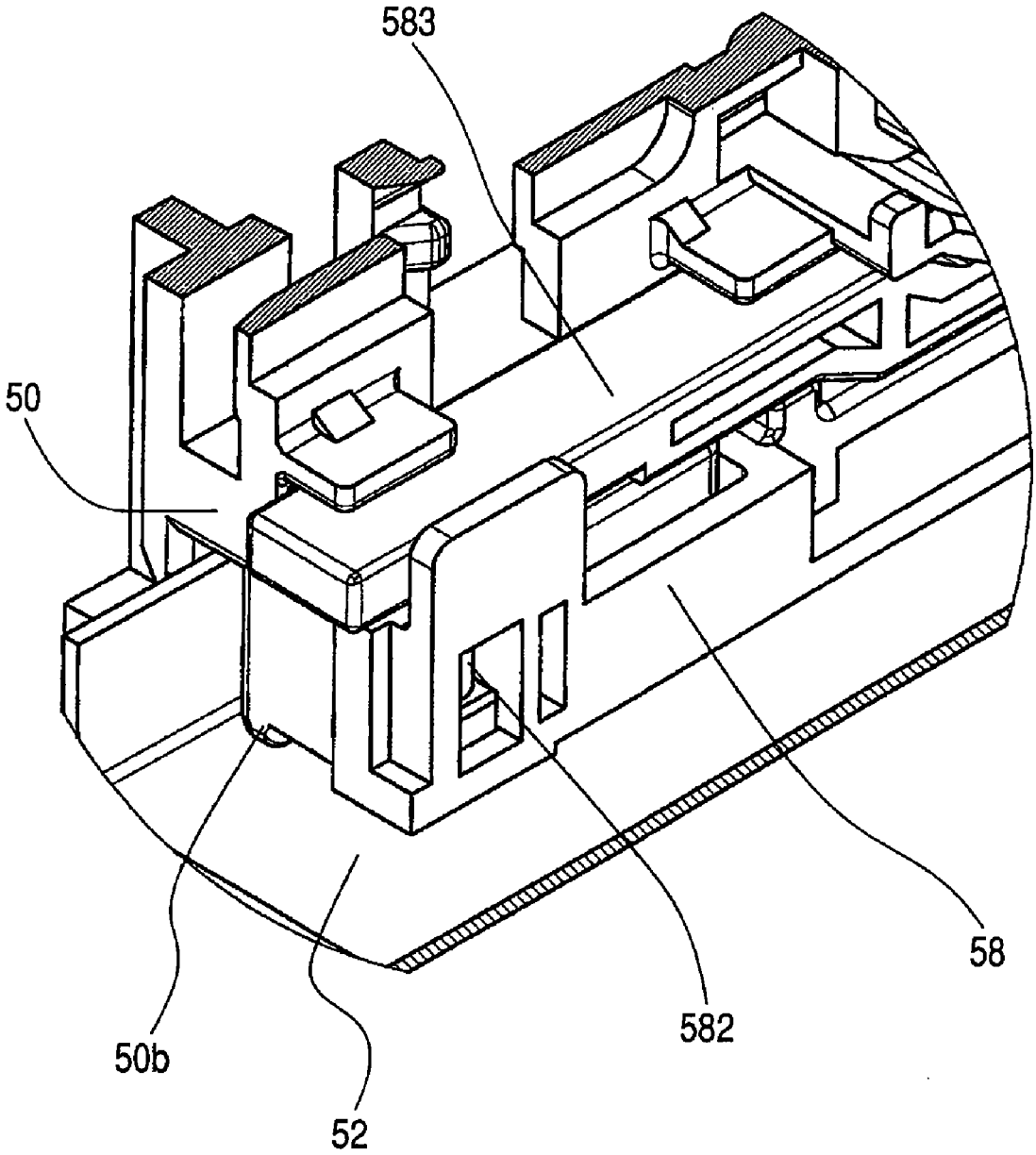
FIG. 6 is an enlarged perspective view of the movable unit and the slide unit of the carriage and their vicinities, as seen from a different angle from FIG. 5.

The carriage 50 includes a movable unit 58 and a slide unit 583. FIG. 5 is an enlarged perspective view of the movable unit 58 and the slide unit 583 of the carriage 50 and their vicinities. FIG. 6 is an enlarged perspective view of the movable unit 58 and the slide unit 583 of the carriage 50 and their vicinities, as seen from a different angle from FIG. 5. Note that the guide unit 52 is not illustrated in FIG. 5.

A second sliding surface 58*b* and a fourth sliding surface 58*a* are formed in the movable unit 58. The second sliding surface 58*b* is parallel to the first sliding surface 50*b*, and the fourth sliding surface 58*a* faces the third sliding surface 50*a*.

The guide unit 52 is sandwiched between the third sliding surface 50*a* and the fourth sliding surface 58*a*. This enables the posture of the carriage to be maintained. Moreover, a lowermost portion of the carriage 50 is specified by the first sliding surface 50*b* or the second sliding surface 58*b*, and one of the first sliding surface 50*b* and the second sliding surface 58*b* contacts the guide unit 52. Thus, the carriage 50 is supported from below by the guide unit 52.

The movable unit 58 is supported so as to be displaceable in a direction intersecting the second sliding surface 58*b*, with respect to the carriage 50. The movable unit 58 may be supported so as to be displaceable in a direction (height direction) orthogonal to the second sliding surface 58*b*.

This enables switching between a first condition in which the guide unit 52 and the first sliding surface 50*b* are in contact with each other and a second condition in which the guide unit 52 and the second sliding surface 58*b* are in contact with each other. In FIG. 3, the carriage 50 in the first condition is illustrated.

The fourth sliding surface 58*a* of the movable unit is biased toward the third sliding surface 50*a* by a spring 581. In this way, the third sliding surface 50*a* and the fourth sliding surface 58*a* are pressed against the guide unit 52.

The third sliding surface 50*b* or the fourth sliding surface 58*b* is typically pressed against the guide unit 52 by a self weight of the carriage 50. Thus, the guide unit 52 maintains the height of the carriage 50, namely, the paper gap, in a constant state.

Figure 7A:
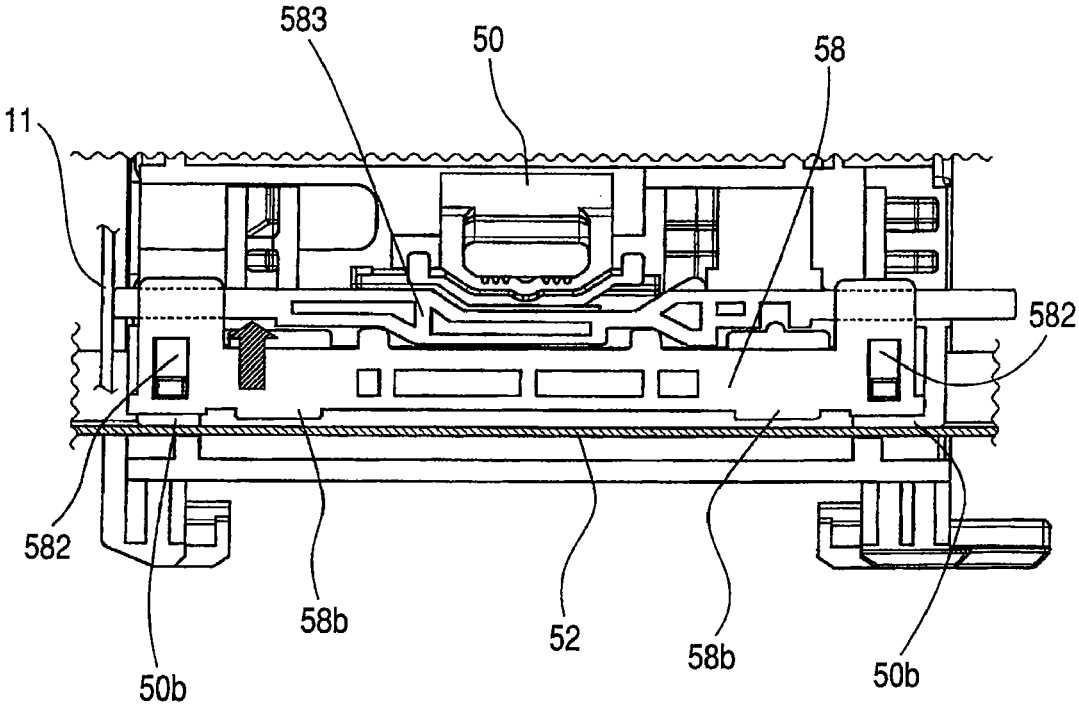
FIG. 7A is a schematic back view of the carriage unit in the first embodiment in a first condition.
Figure 7B:
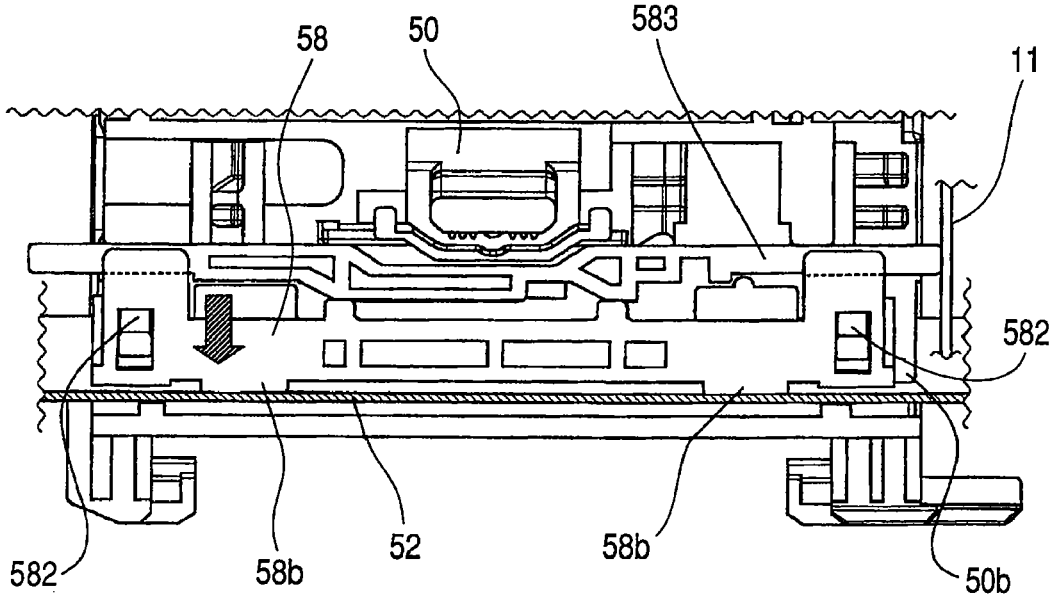
FIG. 7B is a schematic back view of the carriage unit in the first embodiment in a second condition.
Figure 8A:
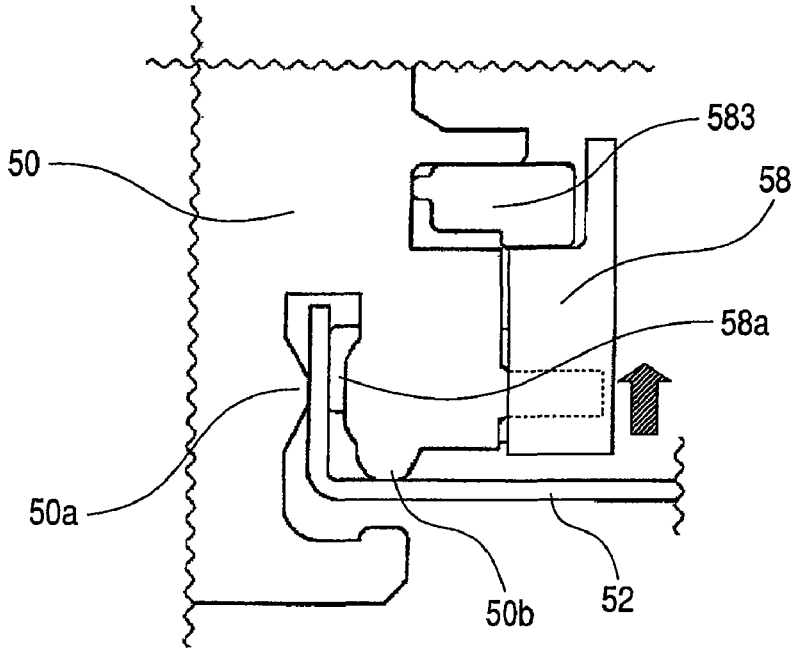
FIG. 8A is an enlarged view of a part corresponding to an area E in FIG. 3 in the first condition.
Figure 8B:
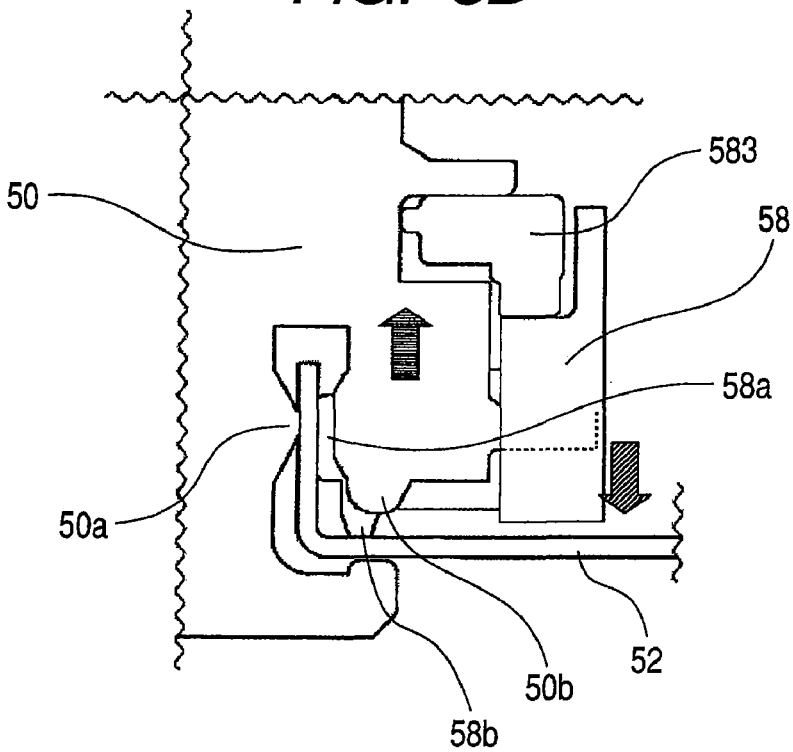
FIG. 8B is an enlarged view of the part corresponding to the area E in FIG. 3 in the second condition.

The following describes a structure for switching between the second condition and the first condition in detail, also with reference to FIGS. 7A to 8B. FIG. 7A is a schematic back view of the carriage unit 5 in the first condition, and FIG. 7B is a schematic back view of the carriage unit 5 in the second condition. FIG. 8A is an enlarged view of a part corresponding to an area E in FIG. 3 in the first condition, and FIG. 8B is an enlarged view of the part corresponding to the area E in the second condition.

The movable unit 58 is biased in a direction away from the guide unit 52, by an elastic body 582 like a spring as an example. The slide unit 583 is disposed so as to be in contact with a surface of the movable unit 58 opposite to the second sliding surface 58*b*. A protrusion formed on the movable unit 58 is in contact with the slide unit 583.

Furthermore, the carriage 50 is situated on a surface of the slide unit 583 opposite to a contact surface with the movable unit 58. That is, the slide unit 583 is sandwiched between the movable unit 58 and the carriage 50.

The slide unit 583 has a shape extending along the main scanning direction. The slide unit 583 is formed slidably in a carriage movement direction (main scanning direction) relative to the carriage 50. A point of contact between the protrusion of the movable unit 58 and the slide unit 583 changes according to this slide of the slide unit 583.

An area of the slide unit 583 in contact with the movable unit 58 has a slope. Accordingly, when the slide unit 583 moves in the main scanning direction with respect to the carriage 50, a width of the slide unit 583 in the height direction changes at the contact surface with the movable unit 58. As a result, the movable unit 58 is displaced up or down with respect to the carriage 50.

Moreover, when the carriage 50 moves to a position immediately before an outermost end of a carriage movement area, an end of the slide unit 583 collides with the chassis 11 of the recording apparatus 1. The chassis 11 is fixed to the recording apparatus 1.

This being so, when the carriage 50 moves to the position immediately before the outermost end, the slide unit 583 becomes stationary with respect to the recording apparatus 1. After this, when the carriage 50 further moves to the outermost end, the slide unit 583 slides relative to the carriage 50.

According to this slide of the slide unit 583, the movable unit 58 is displaced up or down with respect to the carriage 50. When the movable unit 58 moves up, the second sliding surface 58*b* formed on the movable unit is positioned higher than the first sliding surface 50*b*. In this first condition, the second sliding surface 58*b* is not in contact with the guide unit 52 (see FIG. 7A and FIG. 8A).

On the other hand, when the movable unit 58 moves down (second condition), the second sliding surface 58*b* is positioned at an approximately same height as the first sliding surface 50*b* in the case where the recording apparatus 1 is unused. Which is to say, in the case where the first sliding surface 50*b* is abraded, the second sliding surface 58*b* is in contact with the guide unit 52 (see FIG. 7B and FIG. 8B).

In detail, when the carriage 50 moves to the outermost end, the end of the slide unit 583 collides with the chassis 11. This causes a change in relative position of the slide unit 583 and the carriage 50, as a result of which the first condition occurs.

Likewise, when the carriage 50 moves to an opposite outermost end to the above-mentioned outermost end, the other end of the slide unit 583 collides with the chassis 11. This causes a change in relative position of the slide unit 583 and the carriage 50, as a result of which the second condition occurs.

Thus, according to this embodiment, it is possible to switch between the first condition and the second condition by controlling the movement of the carriage 50. In the second condition, the guide unit 52 supports the carriage 50 via the movable unit 58.

In this embodiment, control is exercised so as to be in the first condition at the time of initial use of the recording apparatus 1. In this case, the support and positioning of the carriage 50 in the height direction are made by the first sliding surface 50*b*.

When a recording operation is repeatedly performed in the first condition, the first sliding surface 50*b* repeatedly slides on the guide unit 52 and as a result abrades gradually. The height of the carriage 50 decreases by the amount of abrasion, and the paper gap becomes narrower. To obtain a favorable recorded image, the paper gap needs to be within an appropriate range.

Therefore, when the first sliding surface 50*b* abrades to a certain degree, the first condition is switched to the second condition. Subsequently, the recording operation is performed in the second condition. Since the second sliding surface 58*b* formed on the movable unit 58 is not abraded, the paper gap is at approximately a same level as at the time of initial use.

Hence a recording apparatus that has high durability and can produce a favorable recorded image can be provided.

In this embodiment, during a period before switching to the second condition, the surface of the guide unit 52 in contact with the first sliding surface 50*b* becomes smooth as a result of slide. Which is to say, the slidability of the guide unit 52 is higher than at the time of initial use.

Accordingly, at the time of initial use, a material of lower slidability can be used for the second sliding surface 58*b* than the first sliding surface 50*b*. This is because a same level of slidability as initial use can be attained even after switching to the second condition. Thus, the second sliding surface 58*b* can be formed with a cheap and easily-obtainable material.

In this embodiment, commercial grade polyacetal (POM) is used as the material of the second sliding surface 58*b*. Sliding grade polyacetal (POM) of higher slidability is used as the material of the first sliding surface 50*b*.

The recording apparatus in this embodiment may have a function of quantitatively measuring the degree of abrasion of the first sliding surface 50*b*. By automatically measuring the degree of abrasion, the switching from the first condition to the second condition can be carried out automatically.

Examples of the function of quantitatively measuring the degree of abrasion include a contact sensor, an optical sensor, and the like. By means of the contact sensor, the optical sensor, and the like, an external dimension of the first sliding surface 50*b* is measured and compared with an initial external dimension of the first sliding surface 50*b*. In this way, the degree of abrasion can be determined.

The degree of abrasion need not be directly measured by the above-mentioned sensor. Alternatively, abrasion information pertaining to the degree of abrasion may be measured in order to indirectly estimate the degree of abrasion.

Figure 9:
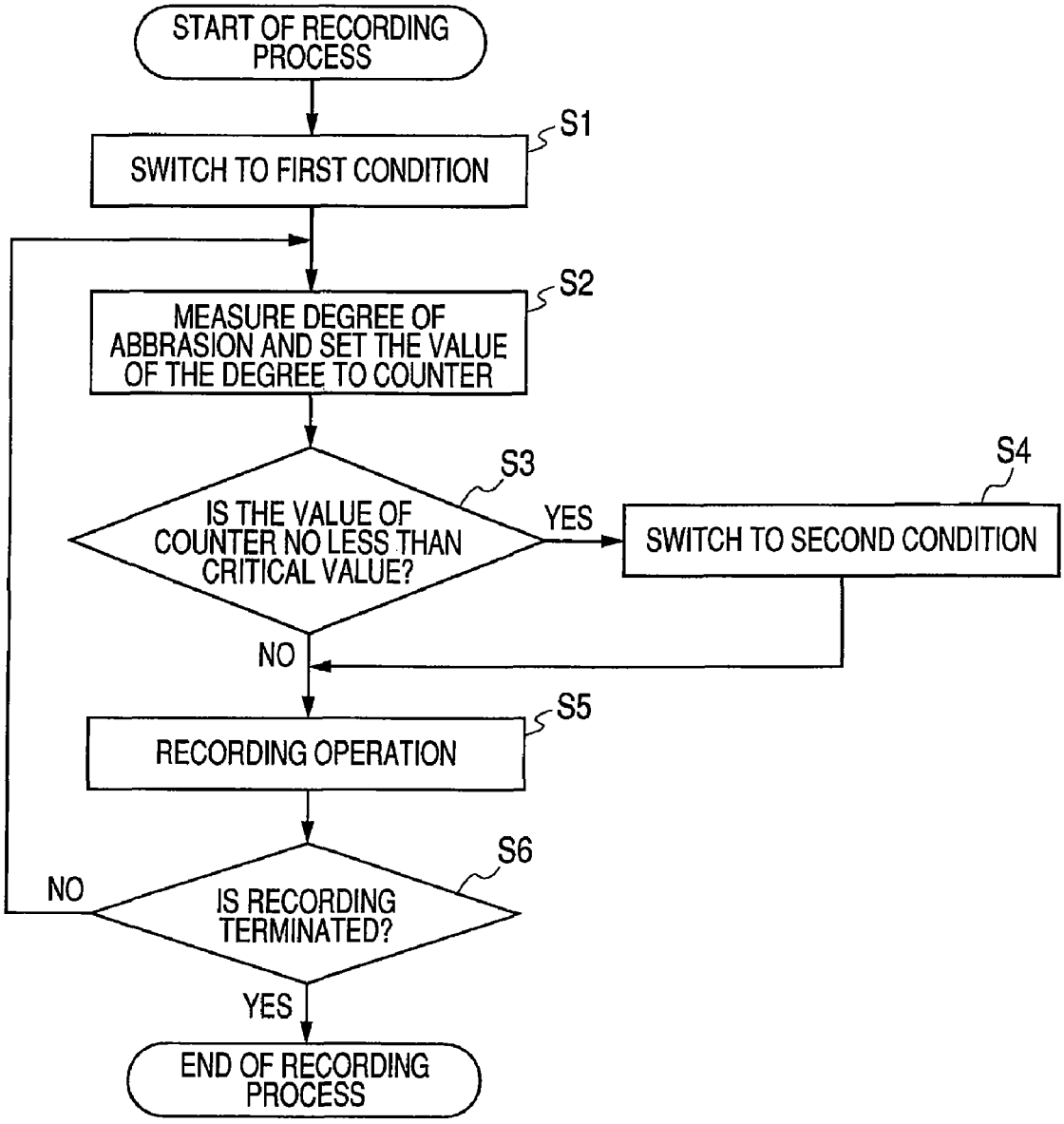
FIG. 9 is a flowchart showing the switching of the movable unit in the first embodiment of the present invention.
Figure 14:
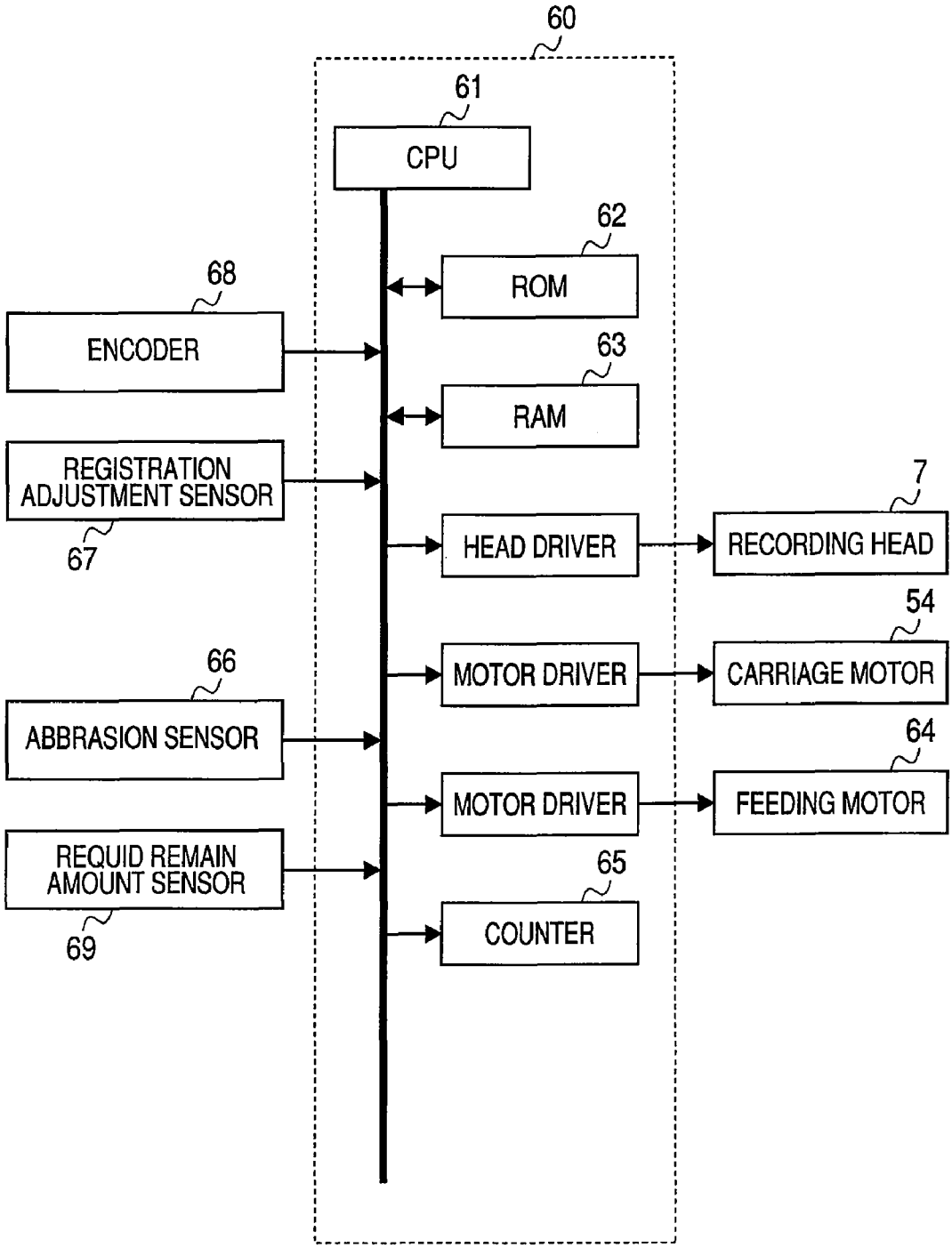
FIG. 14 is a control block diagram in the embodiments of the present invention.

FIG. 9 illustrates an example of a flowchart showing the switching of the movable unit. FIG. 14 illustrates a control circuit diagram. In FIG. 14, a control unit 60 that controls the recording apparatus includes a CPU 61 that issues control commands and performs determination, a ROM on which information such as a program is stored, a RAM which is a storage area for expanding information of image processing and the like, and various drivers. A carriage motor 54 drives the carriage. A feeding motor 64 feeds paper. A sensor 66 measures the degree of abrasion of the first sliding surface 50*b*. In FIG. 9, first the carriage motor 54 is controlled to switch to the first condition at the beginning of the recording process, in step S1. After this, the degree of abrasion (hereafter also referred to as abrasion information) of the first sliding surface 50*b* is measured using the sensor 66 and the measured value is set to a counter 65, in step S2.

Next, the value of the counter 65 is compared with a predetermined critical value set beforehand, in step S3. When the value of the counter is less than the critical value, control proceeds to step S5 to perform the recording operation while maintaining the first condition. When the value of the counter is no less than the critical value, control proceeds to step S4 to switch to the second condition by controlling the carriage motor 54, and then the recording operation is performed.

Next, after a predetermined amount of recording (for example, recording of one recording medium) ends, determination as to whether the recording process is completed or further recording is necessary is made in step S6.

When further recording is necessary, the degree of abrasion of the first sliding surface 50*b* is measured and the measured value is set to the counter again. After this, when the value of the counter is less than the critical value, the recording operation is performed in the first condition. When the value of the counter is no less than the critical value, the recording operation is performed after switching to the second condition.

After the recording operation, determination is made as to whether the recording process is completed or further recording is necessary. Thus, the above-mentioned steps are repeatedly executed until the recording process is completed.

The following describes other parts of the carriage unit 5, with reference to FIGS. 1 and 2. The carriage 50 is driven by the motor 54 attached to the chassis 11, via a timing belt 55. The timing belt 55 is stretched by an idle pulley 56.

In the carriage unit 5, a code strip 57 on which a plurality of marks is formed at a regular interval is provided in parallel with the timing belt 55, in order to detect the position of the carriage 50. That is, the plurality of marks on the code strip 57 is formed at the regular interval along the movement direction of the carriage 50.

The interval of the plurality of marks is typically 150 to 300 lpi. Here, "lpi" is a unit of screen ruling.

Furthermore, an encoder (not illustrated) that reads the above-mentioned marks is provided in the carriage 50. The position of the carriage can be detected by reading the marks using the encoder. This allows the carriage to be scanned accurately.

(B) Feeding Unit

As shown in FIGS. 1 and 2, the feeding unit 2 includes a pressure plate 21 on which the recording medium is loaded, a feeding roller 28 that feeds the recording medium, a separation roller 241 that separates the recording medium, and a return lever 22 that returns the recording medium to a loading position. These components are mounted on a base 20.

The pressure plate 21 can be brought into and out of contact with the feeding roller 28 by a pressure plate cam (not illustrated). A separation sheet 213 made of a material with a high friction coefficient is disposed in a part of the pressure plate 21 facing the feeding roller 28.

The separation sheet 213 prevents double feeding of recording media close to the pressure plate 21 among a plurality of loaded recording media.

In addition, the pressure plate 21 is provided with a side guide 23 that is movable in the main scanning direction. The side guide 23 specifies the loading position of the recording medium. The pressure plate 21 is rotatable about a rotation shaft linked to the base 20, and is biased toward the feeding roller 28 by a pressure plate spring 212.

The feeding roller 28 has a cylinder shape. The feeding roller 28 is rotatable in the recording medium conveyance direction. The feeding roller 28 is driven by a conveying motor (not illustrated) shared with the conveying unit 3. The feeding roller 28 is connected to the conveying motor via a gear which is not illustrated (or a gear train formed by connecting a plurality of gears).

The recording medium loaded on the pressure plate 21 is conveyed toward the conveying unit 3 by being pressed against the feeding roller 28.

Further, a separation roller holder 24 is mounted on the base 20. The separation roller 241 is rotatably attached to the separation roller holder 24. The separation roller holder 24 is rotatable about a rotation shaft provided on the base 20.

The separation roller holder 24 is biased toward the feeding roller 28 by a separation roller spring (not illustrated). This enables the separation roller 241 to be pressed against the feeding roller 28.

A clutch spring is attached to the separation roller 241. When a predetermined load or more is applied, the part where the separation roller 241 is attached can be rotated. The separation roller 241 can be brought into and out of contact with the feeding roller 28, by a separation roller release shaft and a control cam.

The return lever for returning the recording medium to the loading position is rotatably mounted on the base 20, and biased in a release direction by a return lever spring. When returning the recording medium to the loading position, the return lever is rotated by the above-mentioned control cam.

The positions of the pressure plate 21, the return lever 22, and the separation roller 241 are detected by a feeding sensor.

When the above-mentioned feeding unit is driven, only one recording medium out of a plurality of recording media loaded on the pressure plate 21 is separated and supplied to the conveying unit 3.

(C) Conveying Unit

As shown in FIGS. 1 and 2, the conveying unit 3 is attached to the chassis 11 which is formed by bent-up sheet metal. The conveying unit 3 includes a conveying roller 36 that conveys the recording medium, and an end detector that detects an end of the recording medium.

The conveying roller 36 is formed by coating a surface of a metal shaft with fine ceramic particles. Both ends of the metal shaft are not coated and are rotatably attached to a bearing unit. The bearing unit is formed in the chassis 11.

A plurality of pinch rollers 37 that rotates with the conveying roller 36 is provided, too. The plurality of pinch rollers 37 is held by a pinch roller holder 30, and is in contact with the conveying roller 36. The recording medium conveyed to the conveying unit 3 is sandwiched between the conveying roller 36 and the plurality of pinch rollers 37, and further conveyed toward the platen 34.

The platen 34 is attached to the chassis 11. A rib is formed on the platen 34 as a reference surface for conveyance. The rib is used to manage the gap from the recording head 7, and also reduce waving of the recording medium together with the ejection unit 4 described later.

The plurality of pinch rollers 37 is biased by a pinch roller spring so as to be pressed against the conveying roller 36. This generates a force of conveying the recording medium. A rotation shaft of the pinch roller holder 30 is attached to a bearing unit formed in the chassis 11.

Moreover, the above-mentioned end detector is provided to detect a front end and a back end of the recording medium. This enables the conveyance of the recording medium to be detected.

The conveying roller 36 is driven by transmitting, by the timing belt, rotation of the conveying motor which is composed of a direct-current (DC) motor, to a pulley 361 installed on the shaft of the conveying roller 36.

A code wheel 362 for detecting the amount of conveyance by the conveying roller 36 is also provided on the shaft of the conveying roller 36. Marks are formed on the code wheel 362 at an interval of 150 to 300 lpi. Further, a detector for reading these marks is installed at a position adjacent to the code wheel 362.

The recording head 7 that forms an image based on image information is located downstream in the recording medium conveyance direction of the conveying roller 36. As an example, an ink jet recording head is used as the recording head 7.

A liquid accumulating portion 71 that accumulates the liquid to be discharged is detachably installed in the recording apparatus 1. In a typical ink jet recording apparatus, a separate liquid accumulating portion is installed for each color of ink which is the liquid to be discharged.

The recording head 7 can apply heat to the liquid by, for example, a heater. This heat induces film boiling of the liquid. Due to a pressure change resulting from growth or contraction of a bubble caused by the film boiling, the liquid is discharged from a nozzle formed in the recording head 7. With this liquid, an image is formed on the recording medium.

In the above-mentioned structure, the recording medium conveyed to the conveying unit 3 is conveyed to the platen 34 by the pinch rollers 37 and the conveying roller 36. At this time, the front end of the recording medium is detected by the end detector. Thus, the position of recording the image on the recording medium can be determined.

When forming the image on the recording medium, reciprocating scanning of the carriage in the main scanning direction is conducted while conveying the recording medium. During this time, the ink which is the liquid is discharged from the recording head 7 based on an electric signal from an electric substrate disposed in the recording apparatus. In this way, the ink is discharged to the recording medium to produce the recorded image.

(D) Ejection Unit

As shown in FIGS. 1 and 2, the ejection unit 4 includes an ejection roller 40 and a spur 42.

The spur 42 contacts the ejection roller 40 with a predetermined pressure, and is rotatable with the ejection roller 40.

The ejection roller 40 is attached to the platen 34. A plurality of rubber portions is formed on a metal shaft of the ejection roller 40. The ejection roller 40 is driven by transmitting a driving force of the conveying roller 36 via a transmission roller.

For example, the spur 42 is formed by integrally molding a resin unit with a thin stainless steel (SUS) plate around which a plurality of protrusions is provided. The spur 42 is attached to a spur holder 43.

In this embodiment, the spur 42 is attached to the spur holder 43 by a spur spring which is a coil spring formed into a rodlike shape. The spur spring also presses the spur 42 against the ejection roller 40.

The spur 42 includes a type that mainly generates a force of conveying the recording medium, and a type that mainly prevents the recording medium from rising during recording.

According to the above-mentioned structure, the recording medium on which the image is recorded by the recording head 7 is ejected outside the recording apparatus 1 by the ejection roller 40 and the spur 42.

(E) Cleaning Unit

The cleaning unit 6 includes a cap for preventing the discharge surface of the recording head 7 from drying. A pump is connected to the cap.

When the recording head 7 is not in operation, the cap covers the nozzle formed in the recording head 7. This enables the ink inside the nozzle to be kept from drying.

Moreover, by operating the pump in a state where the cap is in tight contact with the recording head 7, the ink is sucked from the nozzle. As a result, thickened ink and foreign substances adhering to the inside and surface of the nozzle can be removed.

Though the recording apparatus in this embodiment has been described above, the structure of the recording apparatus according to the present invention is not limited to the above embodiment. For example, the structures of the feeding unit 2, the conveying unit 3, the ejection unit 4, the cleaning unit 6, and the like may be any known structures.

In this embodiment, the contact surface between the carriage 50 and the guide unit 52 is switched between the first sliding surface 50*b* and the second sliding surface 58*b*. The same switching may also be performed on the third sliding surface and the fourth sliding surface.

Second Embodiment

The abrasion information pertaining to the degree of abrasion of the first sliding surface 50*b* may be information correlated with the amount of abrasion. In this embodiment, the accumulated number of recording media on which recording is performed is used as the abrasion information.

A recording apparatus in this embodiment further includes a counter storing the accumulated recording number in the recording apparatus in the first embodiment. The counter is set to 0 at the time of initial use.

Figure 10:
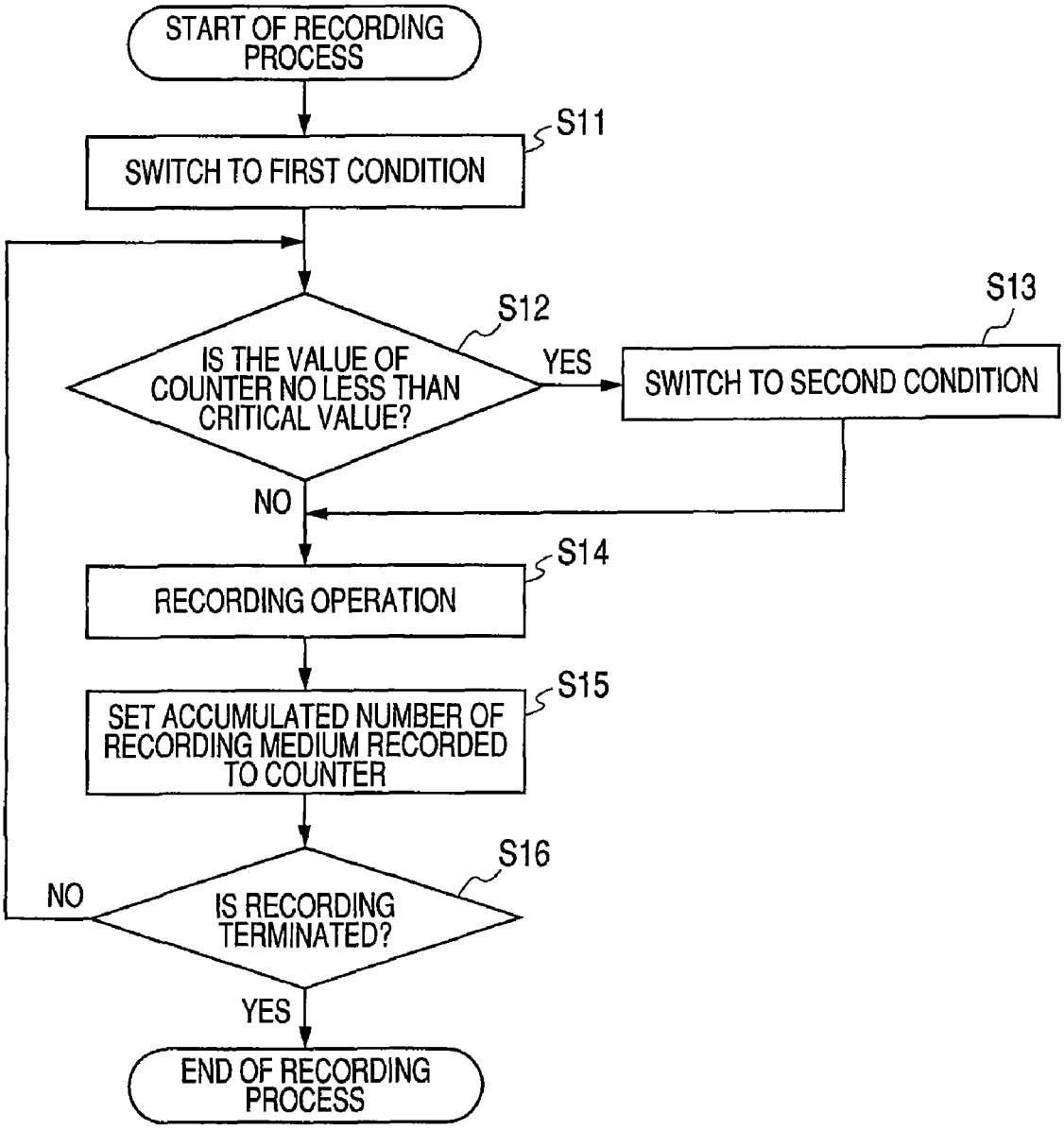
FIG. 10 is a flowchart showing the switching of the movable unit in a second embodiment of the present invention.

FIG. 10 illustrates an example of a flowchart showing the switching of the movable unit. First, the movable unit is switched to the first condition at the beginning of the recording process, in step S11.

Next, the value of the counter 65 is compared with a predetermined critical value set beforehand, in step S12. When the value of the counter 65 is less than the critical value, control proceeds to step S14 to perform the recording operation while maintaining the first condition. When the value of the counter 65 is no less than the critical value, control proceeds to step S13 to switch to the second condition, and then control proceeds to step S14 to perform the recording operation.

After recording is performed on one recording medium, 1 is added to the value of the counter 65 in step S15. That is, the value of the counter is set to the accumulated number of recording media on which recording is performed. Following this, determination is made as to whether the recording process is completed or further recording is necessary, in step S16.

When further recording is necessary, the value of the counter is compared again with the predetermined critical value set beforehand. When the value of the counter is less than the critical value, the recording operation is performed in the first condition. When the value of the counter is no less than the critical value, the recording operation is performed after switching to the second condition. After the recording operation, 1 is added to the value of the counter, and determination is made as to whether the recording process is completed or further recording is necessary.

The above steps are repeatedly performed until the recording process is completed.

In this embodiment, the degree of abrasion is determined based on the accumulated number of recording media on which recording is performed. This has an advantage of simplifying the structure of the recording apparatus, when compared with the case of directly measuring the degree of abrasion.

Third Embodiment

In this embodiment, an accumulated moving distance of the carriage 50 is used as the abrasion information. A recording apparatus in this embodiment further includes a function of measuring a moving distance of the carriage 50 and a counter storing an accumulated moving distance, in the recording apparatus in the first embodiment.

As described in the first embodiment, the recording apparatus 1 includes the code strip 57 on which the marks are formed at the regular interval, and the encoder 68 that reads the marks.

This being so, the moving distance of the carriage 50 is measured as a product of the accumulated number of marks read by the encoder and the mark interval. The amount of abrasion of the first sliding surface 50*b* can be estimated based on the accumulated moving distance of the carriage 50.

Figure 11:
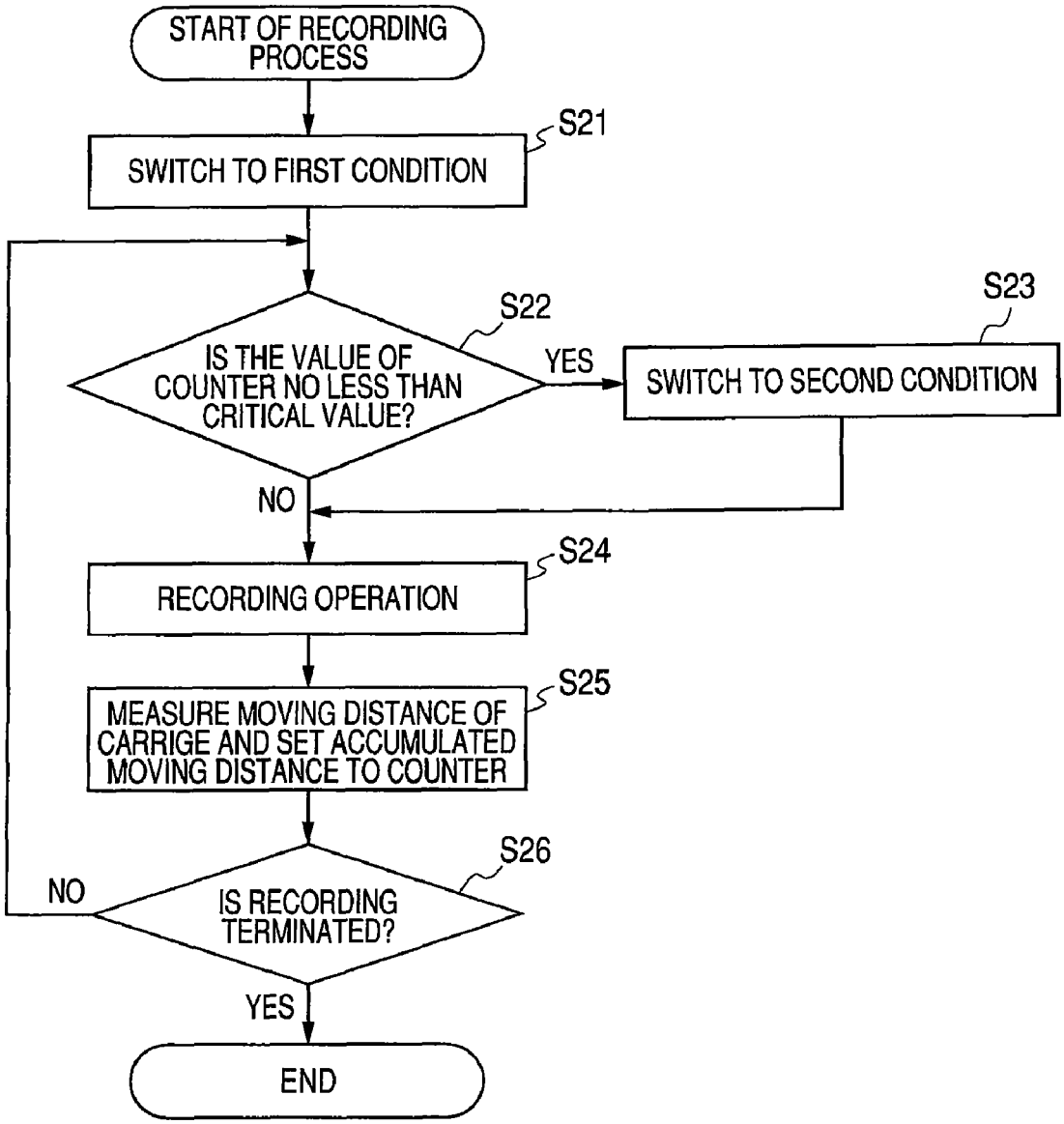
FIG. 11 is a flowchart showing the switching of the movable unit in a third embodiment of the present invention.

FIG. 11 illustrates an example of a flowchart showing the switching of the movable unit. First, the movable unit is switched to the first condition at the beginning of the recording process, in step S21.

Next, the value of the counter is compared with a predetermined critical value set beforehand, in step S22. When the value of the counter is less than the critical value, the recording operation is performed while maintaining the first condition, in step S24. When the value of the counter is no less than the critical value, after switching to the second condition in step S23, the recording operation of a predetermined amount (for example, one recording medium) is performed.

Next, the moving distance of the carriage 50 in the above recording operation is measured and the measured value is added to the counter in step S25. That is, the value of the counter is set to the accumulated moving distance of the carriage 50. Following this, determination is made as to whether the recording process is completed or further recording is necessary, in step S26.

When further recording is necessary, the value of the counter is compared again with the predetermined critical value set beforehand. When the value of the counter is less than the critical value, the recording operation is performed in the first condition. When the value of the counter is no less than the critical value, the recording operation is performed after switching to the second condition. After the recording operation, the moving distance of the carriage 50 is added to the counter, and determination is made as to whether the recording process is completed or further recording is necessary.

The above steps are repeatedly performed until the recording process is completed.

The accumulated moving distance of the carriage 50 has a high correlation with the degree of abrasion. Hence a favorable recording apparatus can be provided.

Alternatively, the accumulated number of marks detected by the encoder may be used instead of the accumulated moving distance of the carriage.

Fourth Embodiment

In this embodiment, the number of times the liquid accumulating portion 71 is exchanged is used as the abrasion information. A recording apparatus in this embodiment further includes a counter storing the number of exchanges of the liquid accumulating portion 71 in the recording apparatus in the first embodiment.

Figure 12:
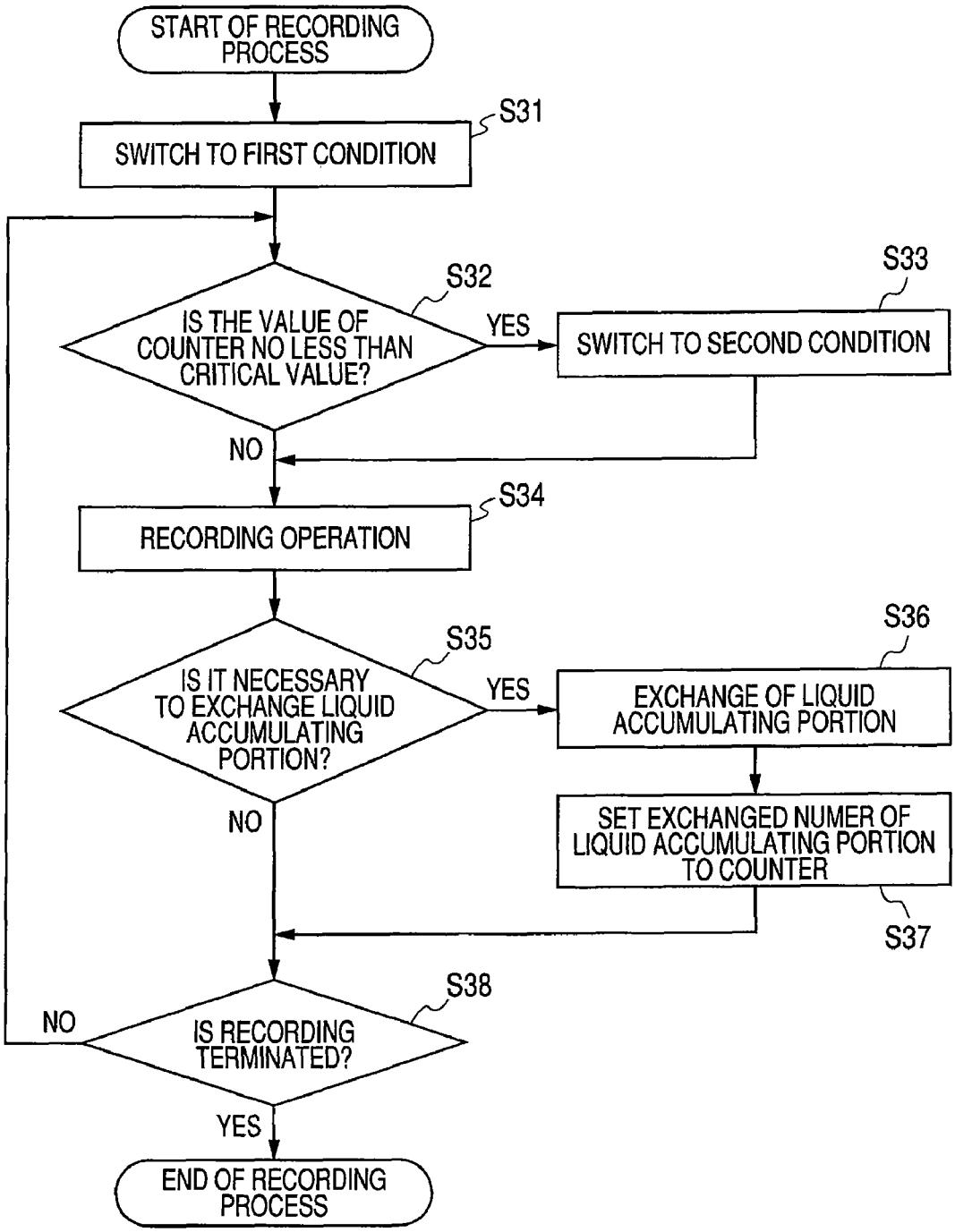
FIG. 12 is a flowchart showing the switching of the movable unit in a fourth embodiment of the present invention.

FIG. 12 illustrates an example of a flowchart showing the switching of the movable unit. First, the movable unit is switched to the first condition at the beginning of the recording process, in step S31.

Next, the value of the counter 65 is compared with a predetermined critical value set beforehand, in step S32. When the value of the counter 65 is less than the critical value, control proceeds to step S34 to perform the recording operation while maintaining the first condition. When the value of the counter is no less than the critical value, control proceeds to step S33 to switch to the second condition, and then the recording operation of a predetermined amount (for example, one recording medium) is performed in step S34.

Next, a liquid remain amount in the liquid accumulating portion 71 is detected by a liquid remain amount sensor 69 to determine whether or not the liquid accumulating portion 71 needs to be exchanged, in step S35. When the amount of liquid accumulated in the liquid accumulating portion 71 is small, the liquid accumulating portion 71 is exchanged in step S36. In the case of exchanging the liquid accumulating portion 71, 1 is added to the value of the counter in step S37. That is, the value of the counter indicates the exchanged number of the liquid accumulating portion 71.

Following this, determination is made as to whether the recording process is completed or further recording is necessary, in step S38.

When further recording is necessary, the value of the counter is compared again with the critical value. When the value of the counter is less than the critical value, the recording operation is performed in the first condition. When the value of the counter is no less than the critical value, the recording operation is performed after switching to the second condition. After the recording operation, determination is made as to whether or not the liquid accumulating portion 71 needs to be exchanged. When the liquid accumulating portion 71 needs to be exchanged, the liquid accumulating portion 71 is exchanged, and 1 is added to the value of the counter. Following this, determination is made as to whether the recording process is completed or further recording is necessary.

The above steps are repeatedly performed until the recording process is completed.

As in the above embodiments, the exchanged number of the liquid accumulating portion 71 has a correlation with the degree of abrasion of the first sliding surface 50*b*. Hence a favorable recording apparatus can be provided.

In the case where the recording apparatus has a structure in which the recording head 7 and the liquid accumulating portion 71 are integrally formed, it is also possible to use the exchanged number of the recording head 7 as the abrasion information.

Fifth Embodiment

In the recording apparatus 1, an adjustment to accurately place the liquid on the recording medium is necessary in order to obtain a favorable recorded image. Such an adjustment is referred to as a registration adjustment. Examples of the registration adjustment include an adjustment of relative positioning at which a plurality of types of liquid (for example, each color of ink) is placed, an adjustment of positioning of go and return routes of the carriage, an adjustment of positioning of a plurality of recording heads, and so on.

The carriage 50 in this embodiment includes a registration adjustment sensor 67 that measures a positional deviation of the liquid placed on the recording medium. An optical sensor can be used as the registration adjustment sensor 67.

The optical sensor includes a light emitting unit and a light receiving unit. The light emitting unit and the light receiving unit are installed so as to face the platen 34. Which is to say, the light emitting unit and the light receiving unit face the recording medium during the recording operation.

Figure 13:
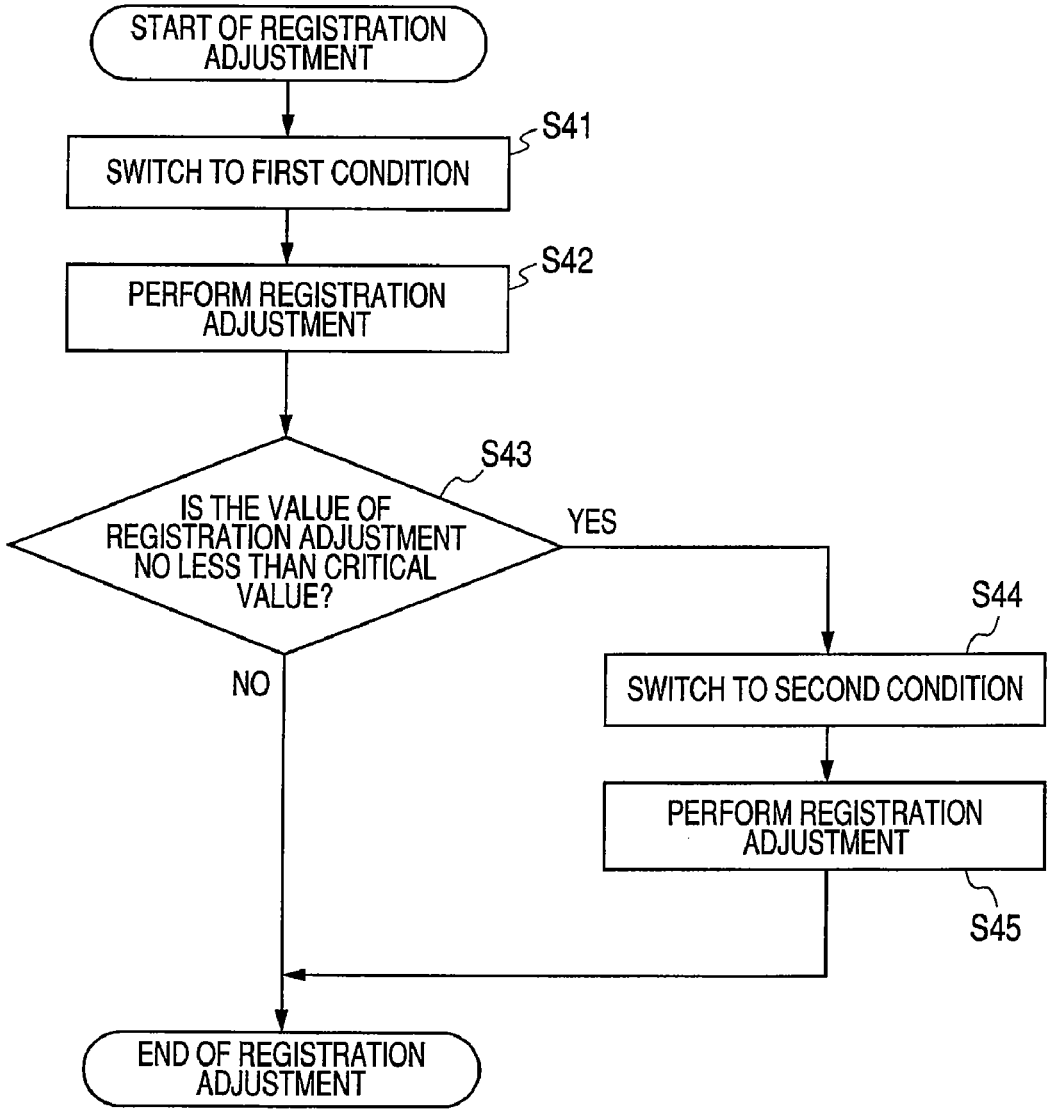
FIG. 13 is a flowchart showing the switching of the movable unit in a fifth embodiment of the present invention.

FIG. 13 illustrates an example of a flowchart showing the switching of the movable unit 58 in this embodiment. First, the movable unit 58 is switched to the first condition at the beginning of the registration adjustment, in step S41. Next, the registration adjustment is conducted in the first condition in step S42.

The registration adjustment is conducted in the following manner. First, a predetermined image pattern is recorded on the recording medium. After this, light is radiated toward the recording medium from the light emitting unit of the optical sensor. Then, reflected light is received and a concentration difference of the image pattern is detected. An optimal adjustment value in the registration adjustment is measured from the concentration difference.

The above-mentioned adjustment value is affected by a change in paper gap. Accordingly, the adjustment value has a correlation with the degree of abrasion, and so can be used as the abrasion information.

Next, the measured adjustment value is compared with a predetermined critical value set beforehand, in step S43. When the adjustment value is less than the critical value, the registration adjustment is completed. When the adjustment value is no less than the critical value, control proceeds to step S44 to switch to the second condition, and then the registration adjustment is performed again in step S45.

Thus, a favorable recorded image can be automatically obtained.

Though the exemplary embodiments of the present invention have been presented and described in detail above, the present invention is not limited to the above embodiments, and it is to be understood that various modifications and changes can be made without departing from the scope of the invention.

For instance, the flowcharts relating to the switching between the first condition and the second condition are merely examples, and the present invention is not limited to the above-mentioned processing flows. Any processing flows are applicable so long as the first condition can be switched to the second condition when abrasion develops.

Moreover, the means of displacing the movable unit 58 is not limited to the means in the above embodiments, and any means is applicable so long as the gap between the second sliding surface 58*b* and the guide unit can be controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-139500, filed May 28, 2008, which is hereby incorporated by reference herein its entirety.

What is claimed is:

1. A recording apparatus comprising:

a carriage that carries a recording head which discharges a liquid onto a recording medium; and a guide unit that supports the carriage so as to be movable, wherein the carriage has a first sliding surface and a second sliding surface, the first sliding surface being slidable on the guide unit, the second sliding surface being displaceable with respect to the carriage and being slidable on the guide unit, wherein the recording apparatus is switchable between a first condition in which the guide unit and the first sliding surface are in contact with each other, and a second condition in which the guide unit and the second sliding surface are in contact with each other, wherein the recording apparatus is in the first condition upon initial use, and wherein the recording apparatus is switched to the second condition after the first sliding surface abrades to a critical value set beforehand.

2. The recording apparatus as claimed in claim 1, wherein the first sliding surface has higher slidability than the second sliding surface, upon the initial use of the recording apparatus.

3. The recording apparatus as claimed in claim 1, wherein the carriage includes a movable unit that is displaceable in a direction orthogonal to the second sliding surface, and wherein the second sliding surface is formed in the movable unit.

4. The recording apparatus as claimed in claim 1, wherein the carriage includes a movable unit that is displaceable in a direction intersecting the second sliding surface, and wherein the second sliding surface is formed in the movable unit.

5. The recording apparatus as claimed in claim 4, further comprising a slide unit that is sandwiched between the carriage and a surface of the movable unit opposite to the second sliding surface, and slides in a movement direction of the carriage, wherein the movable unit is biased in a direction away from the guide unit, and wherein a slope is formed in a surface of the slide unit in contact with the movable unit so that the movable unit is displaced as the slide unit slides.

6. The recording apparatus as claimed in claim 5, wherein when the carriage moves to a position immediately before an outermost end of a movement area of the carriage, an end of the slide unit collides with a chassis of the recording apparatus.

7. The recording apparatus as claimed in claim 1, further comprising a function of quantitatively measuring abrasion information pertaining to a degree of abrasion of the first sliding surface, wherein the recording apparatus is switched to the second condition when the abrasion information is no less than the critical value set beforehand.

8. The recording apparatus as claimed in claim 7, further comprising a liquid accumulating portion that is detachably installed and accumulates the liquid, wherein the abrasion information is a number of times the liquid accumulating portion is exchanged.

9. The recording apparatus as claimed in claim 7, wherein the abrasion information is an accumulated number of recording media on which recording is performed.

10. The recording apparatus as claimed in claim 9, further comprising a registration adjustment sensor that measures a positional deviation of the discharged liquid placed on the recording medium, wherein the abrasion information is a registration adjustment value measured by the registration adjustment sensor.

11. The recording apparatus as claimed in claim 7, wherein the abrasion information is an accumulated moving distance of the carriage.

12. The recording apparatus as claimed in claim 11, further comprising:

a code strip on which marks are formed at a regular interval along a movement direction of the carriage; and an encoder that is provided in the carriage and detects the marks.

* * * * *